US005363525A

United States Patent [19]

Andreasen

[11] Patent Number: 5,363,525

[45] Date of Patent: Nov. 15, 1994

[54] CEILING WIRE TOOL

[76] Inventor: Jon R. Andreasen, P.O. Box 111474, Anchorage, Ak. 99511-1474

[21] Appl. No.: 36,469

[22] Filed: Mar. 24, 1993

[51] Int. Cl.[5] ..... B25B 13/00

[52] U.S. Cl. ..... 7/138; 81/124.2; 140/119

[58] Field of Search ..... 7/107, 117, 138, 170; 81/124.2; 140/118, 119

[56] References Cited

U.S. PATENT DOCUMENTS 4,694,869 9/1987 Wolford et al. ..... 140/118 X 5,012,624 5/1991 Dahlgren ..... 81/124.2 X

*Primary Examiner*—James G. Smith

*Attorney, Agent, or Firm*—John P. O'Banion

[57] ABSTRACT

An apparatus (26) for attaching a screw-type fastener (64) and wire (70) to an overhead support structure (72) for hanging suspended ceilings is disclosed. The apparatus (26), which is coupled to an extension pole (74) and driven by a source of rotary power, includes a body portion (32) and a mammillated head portion (34). A cylindrical cavity (42) extends coaxially through head portion (34) and into body portion (32). A first pair of opposing slots (48, 50) extends radially from the cavity (42) to the outer surface of the apparatus (26) and further extends longitudinally through the head portion (34) and into the body portion (32) where they terminate in substantial alignment with the terminus of the cavity (42). A second pair of opposing slots (52, 54) also extends radially from the cavity (42) to the outer surface of the apparatus (26) and further extends longitudinally through the head portion (34) and into the body portion (32). The second pair of slots (52, 54) extend into the body portion (32) beyond the terminus of the cavity (42) and are oriented substantially perpendicular to the first pair of slots (48, 50). Each slot in the second pair of slots (52, 54) terminates with an edge (56, 58) which is angularly offset away from the terminus of the cavity (42) in relation to the radial axis of the apparatus (26). An annular collar (60) partially surrounds the head portion (34) thereby partially enclosing all of the slots.

22 Claims, 7 Drawing Sheets

CEILING WIRE TOOL

BACKGROUND OF THE INVENTION

1. Field of the Invention

This invention pertains generally to tools, and more particularly to an apparatus for installing fasteners and wires used to support suspended ceiling structures.

2. Description of the Background Art

It is common for ceilings in office buildings, warehouses and the like to be suspended from an overhead support structure. The ceiling typically comprises a frame network which is suspending by wires, and removable panels which are supported by the frame. By removing the panels, access can be gained to electrical wiring, telephone wiring, plumbing, ventilation duct and the like.

Installation of the wires used to suspend the frame network is often facilitated by use of a wire twisting tool coupled to an extension pole or the like. The wire is threaded through a hole in the head of a fastener attached to the overhead support structure, and twisted back around itself for secure attachment. In some installations, the fastener is bolted to the overhead support structure; in most installations, however, the fastener is a screw-type fastener such as a lag which is screwed into the overhead support structure.

As a result of the distance between the ground level and the overhead support structures, as well as the number of wires required to suspending a ceiling, it can be extremely inconvenient for an installer to carry fasteners, wire, and tools up and down a ladder and to move the ladder from location to location. Therefore, tools have been developed which permit the installer to secure a fastener to an overhead support structure and install a wire in the fastener while remaining on the ground. FIG. 5 shows a conventional tool 10 which typically would be attached to an extension pole and used to install a wire and fastener. It is respectfully stipulated, however, that this device does not anticipate or render obvious the applicant's invention.

Typically a screw-type fastener 12 having a flattened head 14 with an eye 16 would be inserted into a slot 18. A wire 20 would then be threaded through the eye 16 and bent over so that each section of the wire is substantially flat against the sides of the tool 10. The tool 10 is then rotated until the fastener 12 is secure, at which point the tool 10 is pulled away from the fastener 12 and the wire 20 drawn out. By continuing to rotate the tool 10, the wire 20 will wrap around itself and produce a configuration substantially similar to that shown in FIG. 6. This type of wrap, however, may pull apart under high tension levels. In addition, when the wire 20 is drawn out of the tool 10, it is not possible to achieve a complete twist. The wire 20 is forced against a collar 22 and, as a result, the wire 20 bends so that a tail portion 24 is left extending outward from the side of tool 10. Then, as the tool 10 continues to be rotated, the tail portion 24 can catch insulation and other materials, thereby producing falling debris. Furthermore, the tail portion 24 remains after the installation is complete and, unless it is cut off, may serve as an obstruction and effectively prevent an adjacent wire from being installed in close proximity. Also, for some installations it may be necessary to install a fasteners into a generally vertical support structure. The generally straight configuration of tool 10 with a blunt nose 96 as shown, however, makes this task difficult in that the tool 10 will abut the vertical support structure when the fastener is being installed at an angle as shown in FIG. 8. Therefore, with a conventional tool, it is necessary to orient the tool 10 substantially perpendicular to the vertical support structure in order to install the fastener. Such an orientation is difficult, if not impossible, to achieve when using a long extension pole from the ground level.

Therefore, there is a need for a tool which can install screw-type fasteners, which can secure wires to the fasteners with a tight and uniform twist, which does not interfere with other structures and materials when being used, and which can install fasteners and wires in vertical support structures at an angle. The present invention meets those needs as well as others which are described herein.

SUMMARY OF THE INVENTION

The present invention pertains to an apparatus which can be used to attach ceiling suspension wires to an overhead support structure by means of a screw-type fastener. The apparatus is attached to an extension pole or the like so that the fasteners and ceiling suspension wires can be installed while standing at the ground level.

By way of example and not of limitation, the apparatus of the present invention includes a body which is elongated and generally cylindrical in shape. Projecting from one end of the body is a generally mamillated head. The head includes a tapered shoulder portion, a generally cylindrical neck portion, and a tapered tip portion.

A generally cylindrical cavity extends coaxially through the head and into the body of the apparatus where it terminates. A first pair of opposing slots projects radially from the cavity to the outer surface of the apparatus and extends longitudinally through the head and into the body where they terminate in substantial alignment with the terminus of the cavity. A second pair of opposing slots also projects radially from the cavity to the outer surface of the apparatus and extends longitudinally through the head and into the body. The second pair of slots, however, extends into the body beyond the terminus of the cavity. Furthermore, the second pair of slots is oriented substantially perpendicular to the first pair of slots; in other words, each of the four slots is separated by approximately 90 degrees of rotation. In addition, each slot in the second pair of slots terminates with an edge which is angularly offset away from the terminus of the cavity in relation to the radial axis of the apparatus. An annular collar surrounds the shoulder and neck portions of the head of the apparatus to partially enclose all of the slots.

The apparatus is used in connection with a telescoping extension pole or the like which is coupled at one end to the body of the apparatus. Preferably the extension pole includes a hollow chamber for storing wires which will be installed, as well as a bell-shaped cup surrounding the pole which encloses the ends of the wires which extend from the hollow chamber. The extension pole includes, at its other end, a coupling device for coupling the pole to a source of rotary power such as an electric drill or the like.

In operation, a screw-type fastener having a substantially flattened head is inserted into the cavity with its flattened head oriented with the first pair of slots. A wire is inserted through a first slot in the second pair of slots, through a hole in the flattened head of the screw-type fastener, and through the second slot in the second pair of slots. Note that the wire must be inserted in the slots in the area between the collar and the body. Approximately 6 inches to 12 inches of wire is left projecting through the second slot, and the wire is then bent against the body and the extension pole. Thereafter, the apparatus is lifted into place and rotated by the source of rotary power until the screw-type fastener is secured to the support structure. The user then pulls back on the apparatus, thereby "popping out" the screw-type fastener with the wire threaded through it. By continuing to rotate the apparatus at this point, a secure, clean, and substantially uniform twist in the wire will be achieved.

An object of the invention is to provide for attaching suspended ceiling fasteners and wires an overhead support structure.

Another object of the invention is to provide for installing suspended ceiling fasteners and wires from the ground level.

Another object of the invention is to eliminate the need to use a ladder when installing suspended ceiling fasteners and wires.

Another object of the invention is to secure a wire use in hanging suspending ceilings to a fastener with a tight and uniform twist coupling.

Another object of the invention is to provide for twisting suspended ceiling wires without damaging insulation.

Another object of the invention is to provide for installing suspended ceiling fasteners and wires with close spacing.

Another object of the invention is to provide for installing suspended ceiling fasteners and wires on horizontal and vertical support structures.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
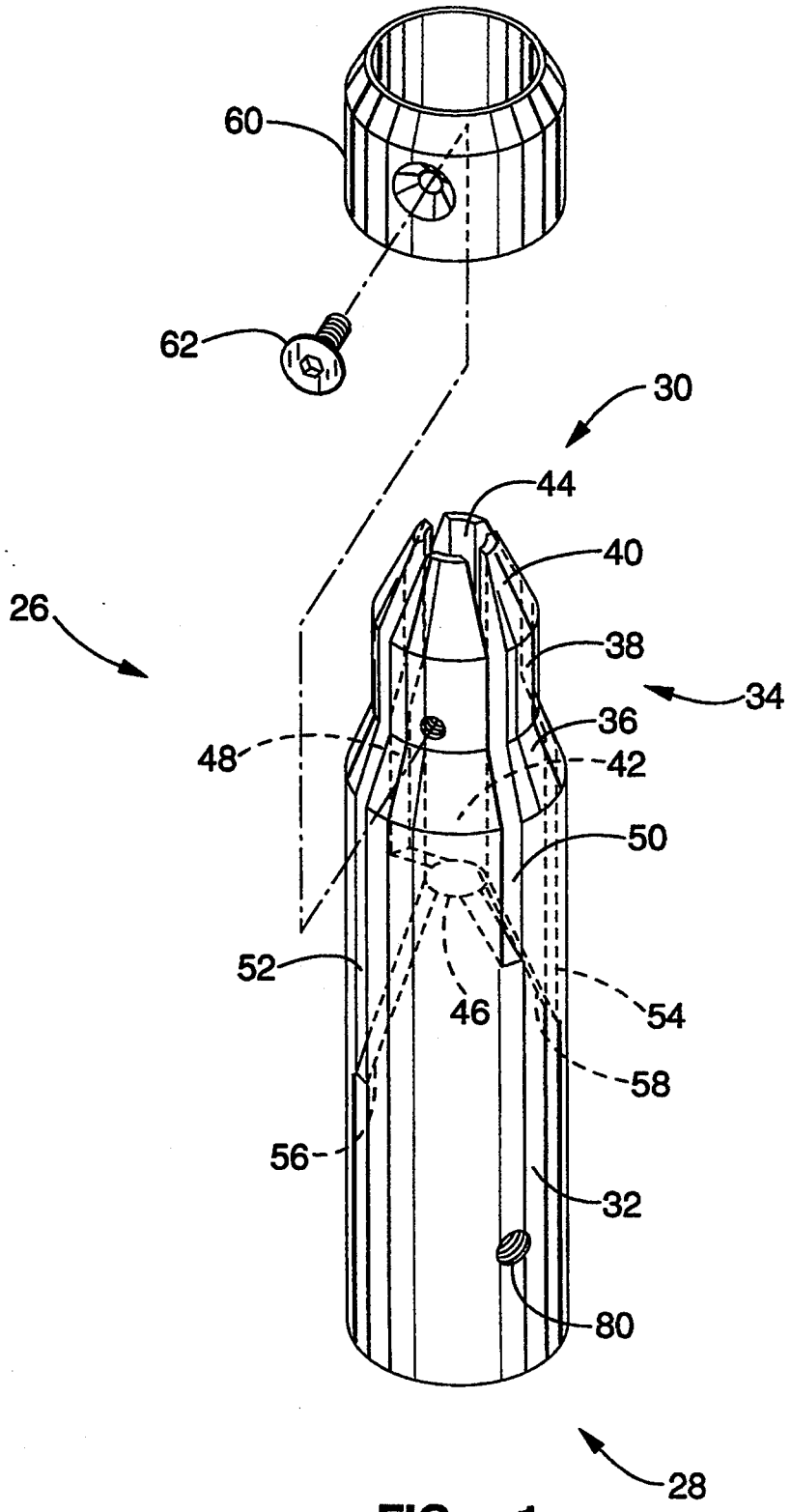
FIG. 1 is an exploded view of the apparatus of the present invention.

Referring more specifically to the drawings, for illustrative purposes the present invention is embodied in the apparatus which is generally shown in FIG. 1. It will be appreciated that the apparatus may vary as to configuration and as to details of the parts without departing from the basic concepts as disclosed herein.

Referring to FIG. 1, the present invention generally comprises a tool 26 having a proximal end 28 and a distal end 30. For purposes of the disclosure herein, the terms "proximal" and "distal" will be used for subparts of tool 26 while are similarly oriented.

The apparatus includes a body portion 32 which is elongated and generally cylindrical in shape. Projecting from the distal end of body portion 32 is a mammillated head portion 34. Head portion 34 includes a tapered shoulder portion 36 which extends from the distal end of body portion 32, a generally cylindrical neck portion 38 of substantially uniform diameter which extends from shoulder portion 36, and a tapered tip portion 40 which extends from neck portion 38. Note also, that head portion 34 has an outer diameter of lesser dimension than body portion 32 which is required for proper operation of the apparatus.

A generally cylindrical cavity 42, having an open distal end 44 and a closed proximal end 46, extends coaxially through head portion 34 and into body portion 32 of the apparatus where it terminates. A first pair of opposing slots 48, 50 extend radially between cavity 42 and the outer surface of the apparatus, and further extend longitudinally from the distal end of the apparatus through the head portion 34 and into the body portion 26 where they terminate in substantial alignment with the proximal end 46 of cavity 42. A second pair of opposing slots 52, 54 also extend radially between cavity 42 and the outer surface of the apparatus, and also further extend longitudinally from the distal end of the apparatus through the head portion 34 and into the body portion 26. Therefore, each of the slots communicates with cavity 42. Slots 52, 54, however, extend into the body portion 32 beyond the proximal end 46 of cavity 42. Furthermore, the slots 48, 50 are oriented substantially perpendicular to slots 52, 54 so that each of the four slots is rotationally separated by approximately 90 degrees. In addition, each slot 52, 54 terminates with an edge 56, 58, respectively, which is angularly offset away from proximal end 46 of cavity 42 toward proximal end 28 of the apparatus, in relation to a radial axis which is perpendicular to the longitudinal axis extending between proximal end 28 and distal end 30 of the apparatus.

An annular collar 60 surrounds shoulder portion 36 and neck portion 38 of head 34 so as to partially enclose slots 48, 50, 52 and 54 as shown. Collar 60 is typically coupled to head portion 34 using a screw-type fastener 62 or the like extending through collar 60 and into neck portion 38. While the entire apparatus can be fashioned from a rigid material such as aluminum, steel, or the like, preferably collar 60 is fashioned from a strong material such as steel so as to minimize the wear on collar 60 which would otherwise result from wires being pulled through the apparatus. A threaded hole 80 is provided on body portion 32 for coupling to an extension pole or the like.

Figure 2:
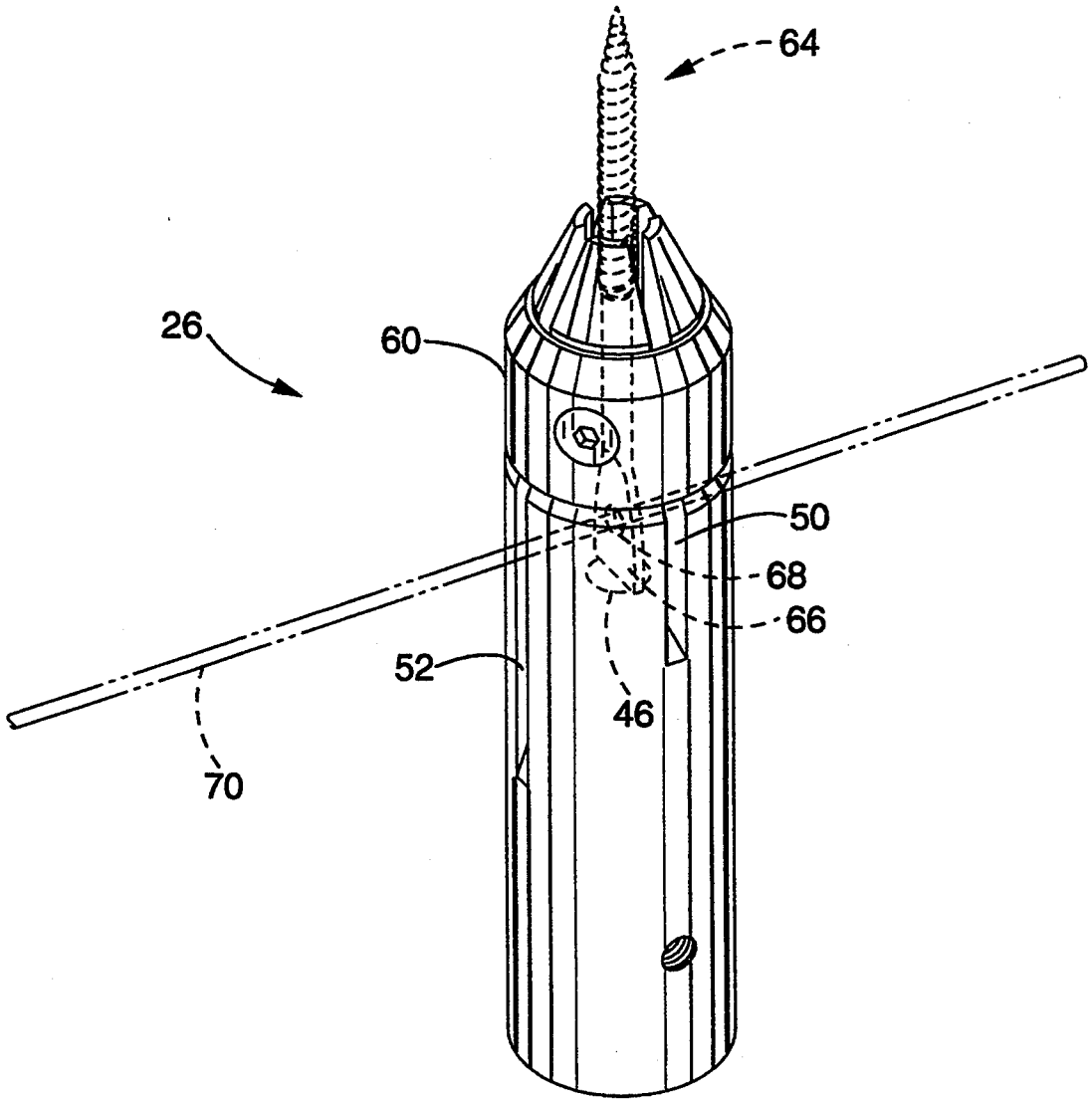
FIG. 2 is a perspective view of a screw-type fastener (shown in phantom) and a wire (shown in phantom) inserted into the apparatus shown in FIG. 1.
Figure 3:
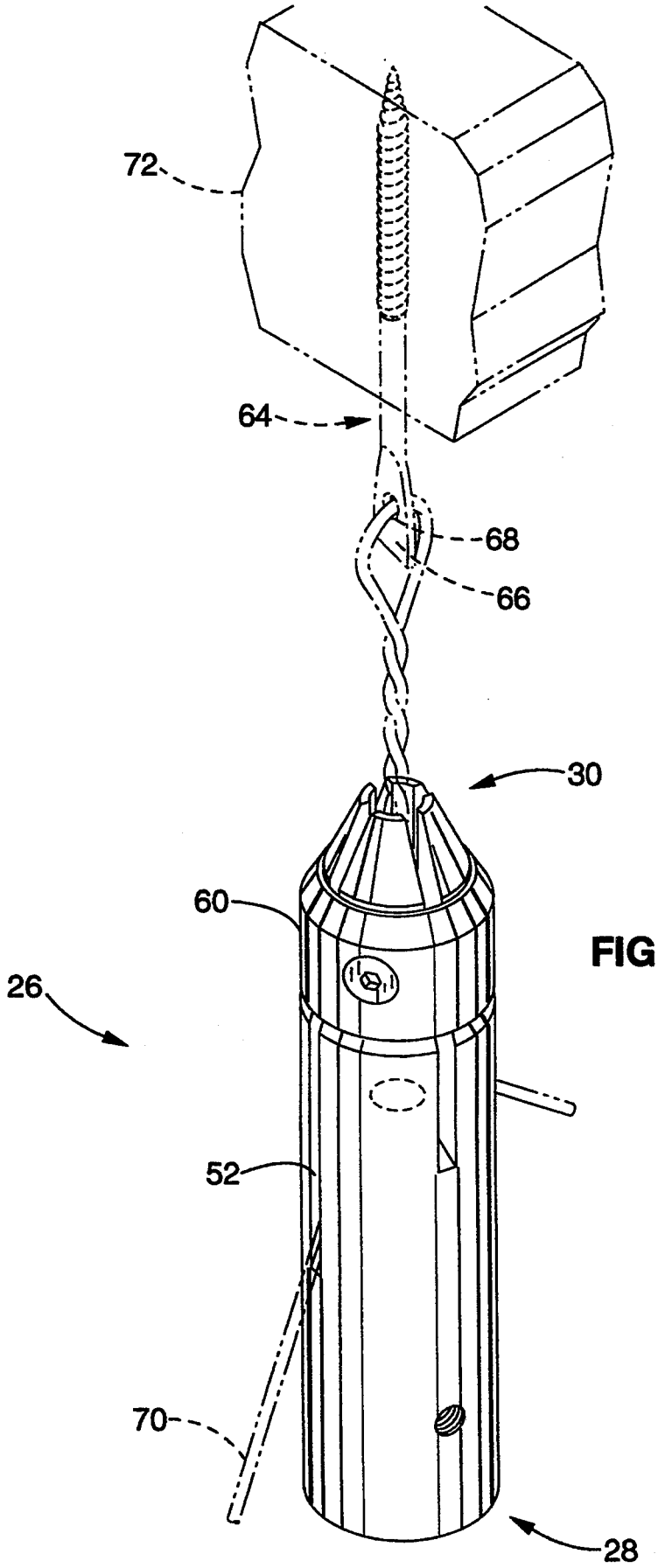
FIG. 3 is a perspective view of a screw-type fastener (shown in phantom) and a wire (shown in phantom) after being rotated and drawn through the apparatus shown in FIG. 1.
Figure 5:
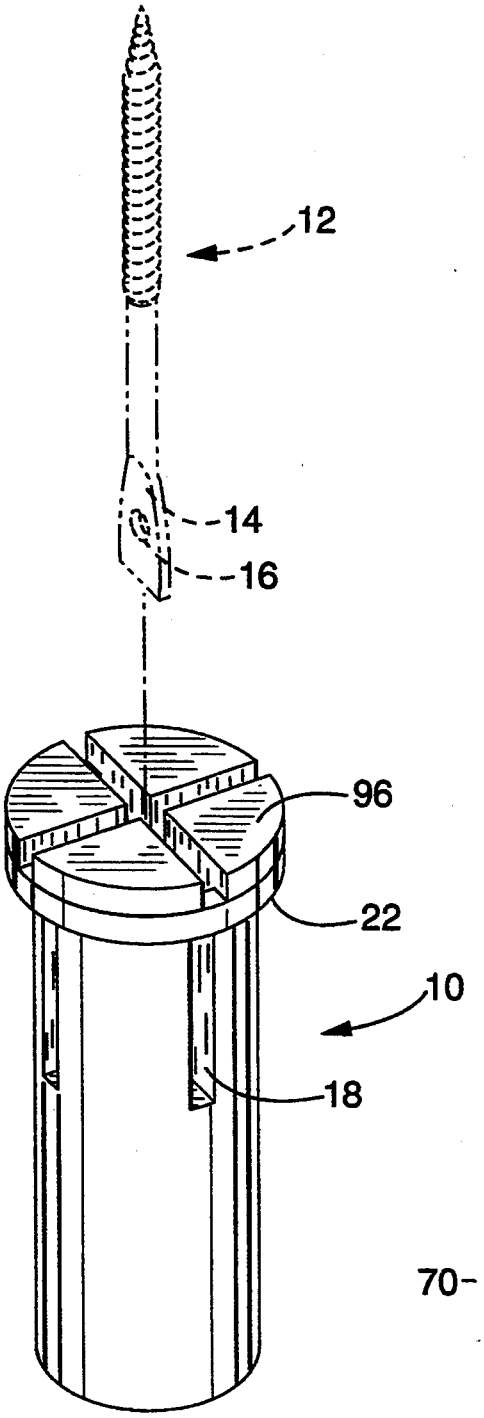
FIG. – 5 PRIOR ART
FIG. 5 is a side elevation view of a prior art tool.

Referring now to FIG. 2, the tool is "loaded" by inserting into cavity 42, a screw-type fastener 64 of the type having a flattened head 66 and an eyehole 68. During insertion of screw-type fastener 64, the edges of the flattened head 66 are aligned with slots 48, 50 and, therefore, slots 48, 50 engage flattened head 66 to prevent its rotation. Furthermore, the end of flattened head 66 will rest at the closed proximal end 46 of cavity 24. A wire 70 is then inserted into slot 52 on the proximal side of collar 60, through eyehole 68, and out of slot 54 on the other side of the apparatus. Typically, the length of wire 70 which is left extending out of slot 54 is approximately 6 inches to 12 inches. Referring to FIG. 1 and FIG. 3, the wire 70 is then bent toward the proximal end 28 of the apparatus so that each side of wire 70 is extends toward proximal end 28 at the angle defined by angled edges 56, 58 in slots 52, 54, respectively.

Next, the apparatus is lifted into place and rotated so that so that screw-type fastener 64 can engage the support structure 72. When screw-type fastener 64 is secure and/or sufficient resistance is met, the user pulls the apparatus away from the support structure 72 thereby "popping out" the screw-type fastener 64 with the wire 70 threaded through it. By continuing to rotate the apparatus at this point, a secure, clean, and substantially uniform twist in the wire 70 will be achieved as can be seen in FIG. 4.

Figure 4:
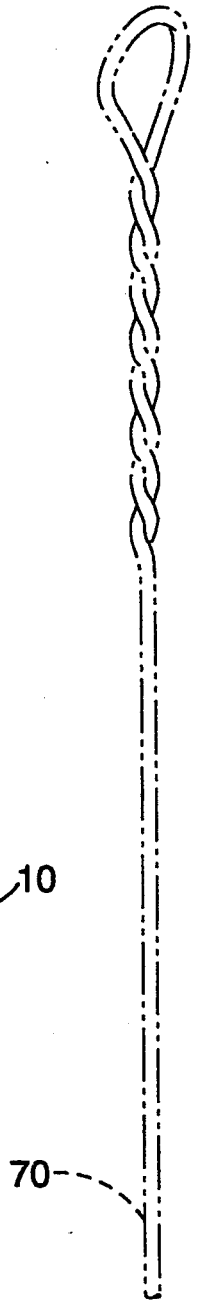
FIG. 4 is a side elevation view of a screw-type fastener (shown in phantom) and a wire (shown in phantom) after being installed with the apparatus shown in FIG. 1.
Figure 6:
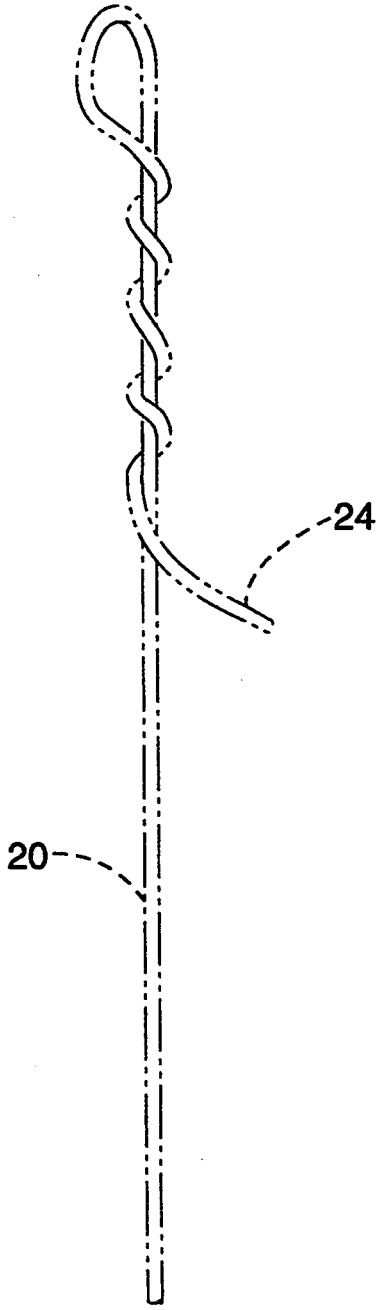
FIG. – 6 PRIOR ART
FIG. 6 is a side elevation view of a screw-type fastener (shown in phantom) and a wire (shown in phantom) after being installed with the apparatus shown in FIG. 5.

The twist shown in FIG. 4 is tighter wound and stronger than twists produced by conventional tools (see FIG. 6) and can withstand pulling forces in excess of those which can be withstood by conventional twists. Furthermore, referring to FIG. 6, conventional tools leave a tail portion 24 on the wire. No such tail portion results when a wire is twisted with the apparatus of the present invention. This permits wires and fasteners to be installed with as little as 1 inch separation, which is essentially dictated by the diameter of the apparatus.

As can be seen, therefore, the superior twist of wire 70 shown in FIG. 4 results from several characteristics of the apparatus. First, the mammillated shape and smaller diameter of head portion 34 produces a tighter bend (smaller angle) in wire 70 when it is first withdrawn from the apparatus. Second, the tighter bend is maintained by the use of the angled edges 56, 58 in slots 52, 54.

Figure 7:
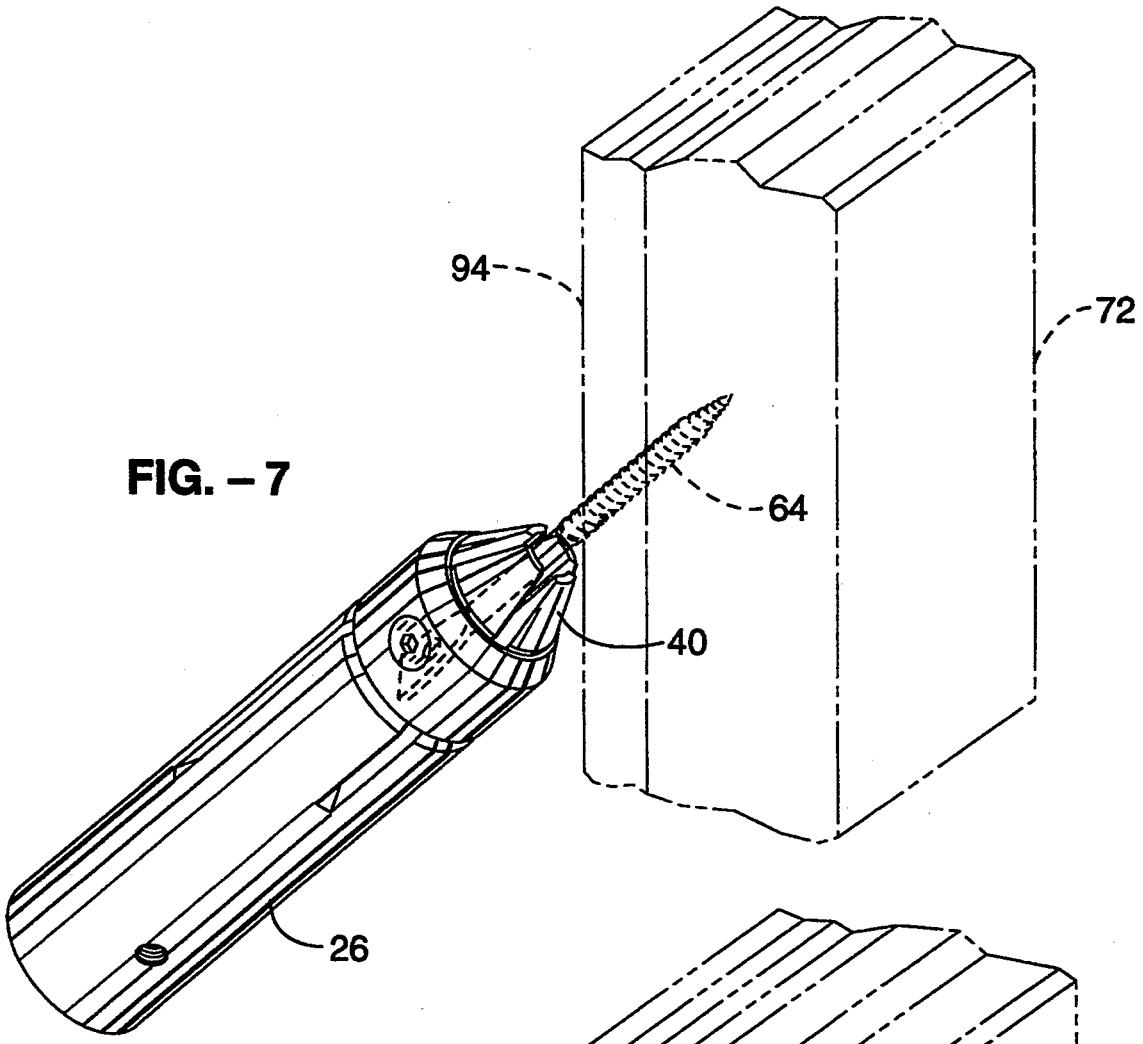
FIG. 7 is a perspective view of the apparatus of FIG. 1 showing a screw-type fastener (shown in phantom) being installed at an angle into a support structure (shown in phantom).
Figure 8:
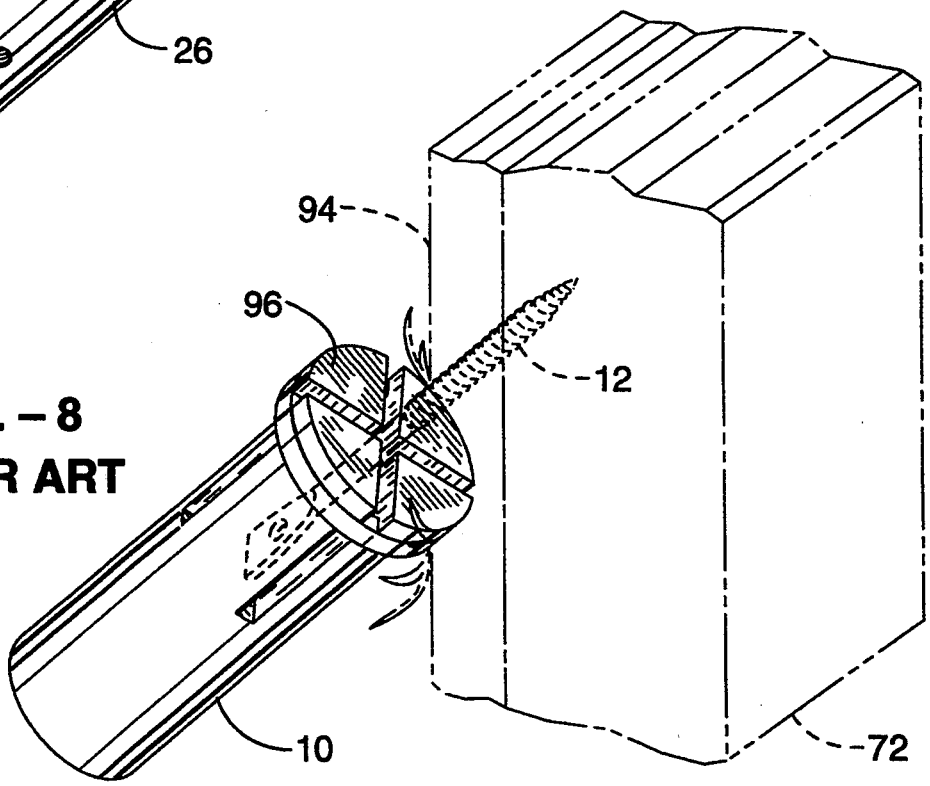
FIG. – 8 PRIOR ART
FIG. 8 is a perspective view of the prior art tool of FIG. 5 showing a screw-type fastener (shown in phantom) being installed at an angle into a support structure (shown in phantom).

Referring also to FIG. 7, the tapered tip portion 40 permits the apparatus 26 to be used for installing screw-type fastener 64 at an angle in a vertically oriented face of a support structure 72. In many cases, the vertical face is covered with drywall 94 or a similar surfacing material. As can be seen in FIG. 8, the blunt nose 96 of a conventional tool 10 makes it difficult to install a fastener at an angle because the outer periphery of nose 96 would hit the drywall before the fastener 12 was completely installed in the support structure 72. Similarly, even if nose 96 were eliminated, the generally straight or cylindrical configuration of the tool 10 would result in the end of the tool abutting the drywall when fastener 12 is being installed at an angle. In the present invention, however, use of a tapered tip portion 40 permits angled installation of screw-type fastener 64 if desired, and permits the fastener 64 to penetrate the drywall and fully seat in support structure 72 without damaging the drywall.

Figure 9:
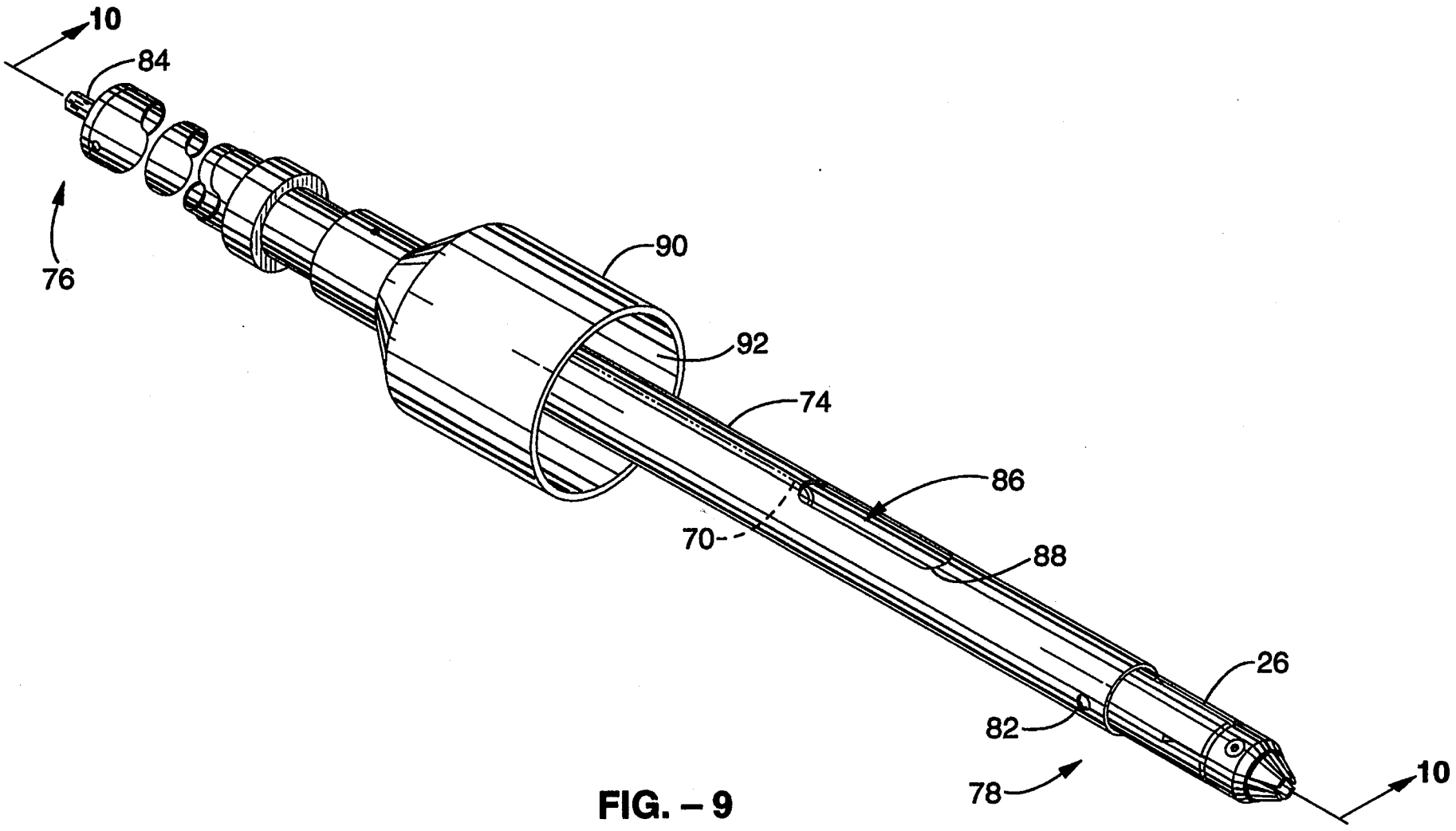
FIG. 9 is a perspective view showing the apparatus of FIG. 1 coupled to an extension pole having a safety bell.
Figure 10:
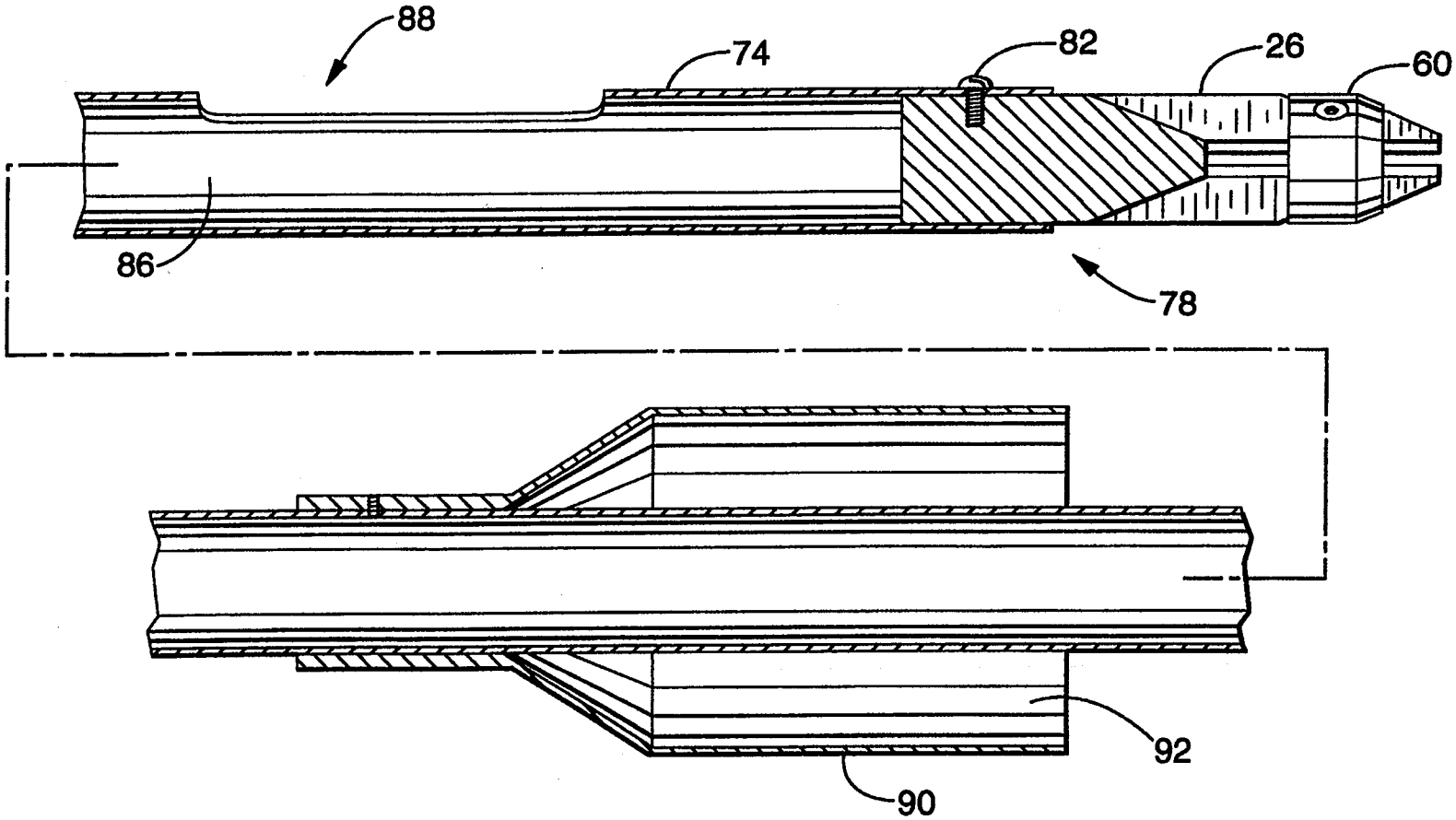
FIG. 10 is a cross-section view of the assembly shown in FIG. 9 taken through line 10—10.

Referring to FIG. 9 and FIG. 10, the apparatus is used in connection with a telescoping extension pole 74 or the like having a proximal end 76 and a distal end 78. Extension pole 74 is hollow at its distal end 78 so that body portion 32 can be inserted therein. Body portion 32 includes a threaded hole 80 (FIG. 1) into which a screw-type fastener 82 or the like can be inserted to secure body portion 32 to extension pole 74. Coupled to the proximal end 76 of extension pole 74 is a hex-shaped coupling device 84 or the like for coupling extension pole 74 to a source of rotary power such as an electric drill or the like.

Preferably extension pole 74 includes a hollow chamber 86 which is accessible through opening 88 for storing wires 70 in a bent configuration as shown. In this configuration, however, a portion of the wires will be inside hollow chamber 86 and, therefore, be covered, while a portion of the wires will extend outside of hollow chamber 86 and along the surface of extension pole 74. So as to prevent the uncovered ends of the wires 70 from extending outward from extension pole 74 and possibly catching insulation and other materials when extension pole 74 is rotated, extension pole 74 also includes a bell-shaped cup 90 through which extension pole 74 coaxially extends. Cup 90 includes an open chamber 92 into which the ends of wires 70 are inserted.

Accordingly, it will be seen that this invention provides a safe, effective, and efficient tool for installing screw-type fasteners and wires for hanging suspending ceilings from overhead support structures. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A tool for installing suspending ceiling fasteners and wires, comprising:

(a) a generally cylindrical body portion;

(b) a generally mammillated head portion, said head portion extending from an end of said body portion, said head portion including a tapered tip portion;

(c) a generally cylindrical cavity, said cavity extending coaxially through said head portion and into said body portion wherein said cavity terminates at a closed end;

(d) a first plurality of slots, said first plurality of slots extending longitudinally through said head portion and into said body portion, said first plurality of slots communicating with said cavity;

(e) a second plurality of slots, said second extending longitudinally through said head portion and into said body portion, said second plurality of slots communicating with said cavity, said second plurality of slots positioned substantially perpendicular to said first plurality slots.

2. An apparatus as recited in claim 1, wherein said head portion further includes a tapered shoulder portion extending from said body portion and a generally cylindrical neck portion extending from said shoulder portion, said tapered tip portion extending from said neck portion.

3. An apparatus as recited in claim 2, further comprising an annular collar, said annular collar substantially surrounding said shoulder portion and said neck portion, said annular collar partially enclosing said first and second plurality of slots.

4. An apparatus as recited in claim 3, wherein each slot in said second plurality of slots terminates with an edge which is angularly offset toward said proximal end of said body portion in relation to a radial axis which is perpendicular to a longitudinal axis extending through said body portion between said proximal end of said body portion and said distal end of said body portion.

5. An apparatus for installing suspended ceilings and the like, comprising:

(a) a generally cylindrical body portion, said body portion having a proximal end and a distal end;

(b) a mammillated head portion, said head portion having a proximal end and a distal end, said head portion extending from said distal end of said body portion, said head portion including a tapered tip portion;

(c) a generally cylindrical cavity, said cavity having a distal open end and a proximal closed end, said cavity extending coaxially through said head portion and into said body portion wherein said cavity terminates at said proximal closed end;

(d) a first plurality of slots, said first plurality of slots extending radially from said cavity and further extending longitudinally from said distal end of said portion head portion, through said head portion, and into said body portion; and (e) a second plurality of slots, said second plurality of slots extending radially from said cavity and further extending longitudinally from said distal end of said head portion, through said head portion, and into said body portion, said second plurality of slots positioned substantially perpendicular to said first plurality slots.

6. An apparatus as recited in claim 5, wherein said head portion further includes a tapered shoulder portion extending from said body portion and a generally cylindrical neck portion extending from said shoulder portion, said tapered tip portion extending from said neck portion.

7. An apparatus as recited in claim 6, further comprising an annular collar, said annular collar substantially surrounding said shoulder portion and said neck portion, said annular collar partially enclosing said first and second plurality of slots.

8. An apparatus as recited in claim 7, wherein each slot in said second plurality of slots terminates with an edge which is angularly offset toward said proximal end of said body portion in relation to a radial axis which is perpendicular to a longitudinal axis extending through said body portion between said proximal end of said body portion and said distal end of said body portion.

9. An apparatus as recited in claim 5, further comprising an extension pole, said extension pole having a proximal end, a distal end and an outer surface, said distal end of said extension pole coupled to said proximal end of said body portion.

10. An apparatus as recited in claim 9, further comprising power coupling means for coupling said proximal end of said extension pole to a source of rotary power.

11. An apparatus as recited in claim 10, further comprising:

(a) wire storing means for storing a wire of the type used for supporting a suspending ceiling, said wire storing means disposed in said extension pole; and (b) wire retaining means for retaining said wire adjacent to said outer surface of said extension pole and enclosing an end of said wire, said wire retaining means coupled to said extension pole.

12. An apparatus as recited in claim 11, wherein said wire holding means comprises:

(a) a hollow chamber disposed in said extension pole; and (b) an elongated opening in said extension pole communicating with said chamber.

13. An apparatus as recited in claim 12, wherein said wire retaining means comprises and bell-shaped member having in inner cup portion, said extension pole extending coaxially through said bell-shaped member, said inner cup portion proximate to said elongated opening in said extension pole.

14. A suspension wire and fastener installation tool, comprising:

(a) a generally cylindrical body portion having a proximal end, a distal end, and an outer surface;

(b) a head portion, said head portion having a proximal end, a distal end, and an outer surface, said head portion including a tapered shoulder portion extending from said distal end of said body portion, a neck portion extending from said shoulder portion, and a tapered tip portion extending from said neck portion, said head portion coaxially aligned with said body;

(c) a generally cylindrical cavity extending coaxially through said head portion and terminating in said body portion;

(d) a plurality of fastener guide slots, said fastener guide slots extending from said distal end of said head portion and into said body portion, said fastener guide slots further extending radially from said cavity to said outer surface of said body portion and said outer surface of said head portion; and (e) a plurality of wire guide slots, said wire guide slots extending from said distal end of said head portion and into said body portion, said wire guide slots further extending radially from said cavity to said outer surface of said body portion and said outer surface of said head portion, said wire guide slots positioned substantially perpendicular to said fastener guide slots.

15. An apparatus as recited in claim 14, further comprising an annular collar, said annular collar substantially surrounding said shoulder portion and said neck portion of said head, said annular collar partially enclosing said fastener guide slots and said wire guide slots.

16. An apparatus as recited in claim 15, wherein each slot in said plurality of wire guide slots terminates with an edge which is angularly offset toward said proximal end of said body portion in relation to a radial axis which is perpendicular to a longitudinal axis extending through said body portion between said proximal end of said body portion and said distal end of said body portion.

17. An apparatus as recited in claim 16, further comprising an extension pole, said extension pole having a proximal end, a distal end and an outer surface, said distal end of said extension pole coupled to said proximal end of said body portion.

18. An apparatus as recited in claim 17, further comprising power coupling means for coupling said proximal end of said extension pole to a source of rotary power.

19. An apparatus as recited in claim 18, further comprising:

(a) a hollow chamber disposed in said extension pole;

(b) an elongated opening in said extension pole communicating with said chamber;

(c) a bell-shaped member having in inner cup portion, said extension pole extending coaxially through said bell-shaped member, said inner cup portion proximate to said elongated opening in said extension pole.

20. A tool for installing wire fasteners and wires used to hang suspended ceilings and the like, comprising:

(a) a generally cylindrical body portion, said body portion having a proximal end and a distal end;

(b) a head portion, said head portion extending from said distal end of said body portion, said head portion of lesser diameter than said body portion, said head portion including a tapered shoulder extending from said distal end of said body portion, said head portion including a generally cylindrical neck portion extending from said shoulder portion, said head portion including a tapered tip portion extending from said neck portion;

(c) a generally cylindrical cavity, said cavity having a distal open end and a proximal closed end, said cavity extending coaxially through said head portion and into said body portion toward said proximal end of said body portion wherein said cavity terminates at said closed end;

(d) a first pair of opposing slots, each of said slots extending radially from said cavity, each of said slots further extending from said head portion and into said body portion toward said proximal end of said body portion;

(e) a second pair of opposing slots, each of said slots extending radially from said cavity, each of said slots further extending from said head portion and into said body portion toward said proximal end of said body portion, each of said slots terminating with an edge which is angularly offset toward said proximal end of said body portion in relation to a radial axis perpendicular to a longitudinal axis extending through said body portion between said proximal end of said body portion and said distal end of said body portion, said second pair of opposing slots positioned substantially perpendicular to said first pair of opposing slots; and (f) an annular collar, said annular collar substantially surrounding said shoulder portion and said neck portion of said head, said collar partially enclosing said first and second plurality of slots.

21. An apparatus as recited in claim 20, further comprising:

(a) an extension pole, said extension pole having a proximal end and a distal end, said distal end of said extension pole coupled to said proximal end of said body portion; and (b) comprising power coupling means for coupling said proximal end of said extension pole to a source of rotary power.

22. An apparatus as recited in claim 21, further comprising:

(a) wire storing means for storing a wire of the type used for supporting a suspending ceiling, said wire storing means disposed in said extension pole; and (b) wire retaining means for retaining said wire adjacent to said outer surface of said extension pole and enclosing an end of said wire, said wire retaining means coupled to said extension pole.

* * * * *